US006387138B1

(12) United States Patent
Murayama et al.

(10) Patent No.: US 6,387,138 B1
(45) Date of Patent: May 14, 2002

(54) DIESEL FUEL COMBUSTION SYSTEM

(75) Inventors: Tadashi Murayama, Hokkaido; Masayoshi Yamashita; Hideya Yoshitake, both of Tokyo, all of (JP)

(73) Assignee: Ube Industries, Ltd., Yamaguchi (JP)

( * ) Notice: Subject to any disclaimer, the term of this patent is extended or adjusted under 35 U.S.C. 154(b) by 0 days.

(21) Appl. No.: 08/604,169

(22) Filed: Feb. 21, 1996

(30) Foreign Application Priority Data

Feb. 21, 1995 (JP) ..... 7-032634

(51) Int. Cl.[7] ..... C10L 1/18
(52) U.S. Cl. ..... 44/387; 123/1 A; 431/2
(58) Field of Search ..... 44/387; 123/1 A; 431/2

(56) References Cited

U.S. PATENT DOCUMENTS 2,331,386 A * 10/1943 Gaylor ..... 44/387
4,380,455 A * 4/1983 Smith ..... 44/387
4,891,049 A * 1/1990 Dillon et al. ..... 44/387
4,904,279 A * 2/1990 Kanne et al. ..... 44/387
5,004,480 A * 4/1991 Kanne ..... 44/387
5,425,790 A * 6/1995 Liotta, Jr. et al. ..... 44/443

* cited by examiner

*Primary Examiner*—Margaret Medley
(74) *Attorney, Agent, or Firm*—Reed Smith LLP

(57) ABSTRACT

Smoke and nitrogen oxide in exhaust gases of diesel engines are reduced by burning a diesel fuel composition having a major portion of diesel fuel and 0.1 to 40 vol. % of a carbonic acid diester of the formula:

in which R represents a lower hydrocarbon group having 1 to 6 carbon atoms, in a diesel engine by injecting the diesel fuel composition into a crank case at an injection timing of 17 to 2° CA, preferably, 14 to 8° CA, in terms of BTDC. EGR (exhaust gas recirculation system) is advantageously employable.

6 Claims, 10 Drawing Sheets

DIESEL FUEL COMBUSTION SYSTEM

FIELD OF THE INVENTION

The present invention relates to an improved diesel fuel combustion system which produces an exhaust gas containing reduced amounts of smoke and nitrogen oxide.

BACKGROUND OF THE INVENTION

U.S. Pat. No. 2,331,386 describes addition of an alkyl carbonate such as dibutyl carbonate to liquid fuels of the type employed in oil furnaces and those used in internal combustion automotive engines, particularly to high flash point spark-ignition engine, to impart improved fluidity and anti-knock value to the fuels. It is further described that the dialkyl carbonate blended with a Diesel fuel shows no appreciable alteration in the cetane number of the fuel.

U.S. Pat. Nos. 4,891,049 and 4,904,279 describe that hydrocarbon fuels heavier than gasoline, especially diesel fuel compositions, containing carbonate additives, preferably non-aromatic, metals-free carbonates, to reduce particulate emissions therefrom when combusted in an internal combustion engine.

PCT International Publication WO 84-02339 describes that an internal combustion engine fuels, preferably gasoline, containing a combination of t-butanol and a dialkyl carbonate is effective to significant increase in both Research Octane Number (RON) and Motor Octane Number (MON).

SUMMARY OF THE INVENTION

It has been now discovered by the present inventors that production of both smoke and nitrogen oxide in an exhaust gas of a diesel engine can be significantly reduced by employing a combination of a diesel fuel composition containing a carbonic acid ester, particularly, a dialkyl carbonate, and a specifically selected diesel engine operating condition.

Accordingly, it is an object of the invention to provide an improved diesel fuel combustion system which produces an exhaust gas containing a reduced amount of smoke as well as a reduced amount of nitrogen oxide.

The present invention resides in a diesel fuel combustion system which comprises burning a diesel fuel composition comprising a major portion of diesel fuel and 0.1 to 40 vol. % of a carbonic acid diester of the formula:

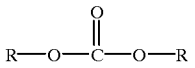

in which R represents a lower hydrocarbon group having 1 to 6 carbon atoms in a diesel engine by injecting the diesel fuel composition into its combustion room at an injection timing of 17 to 2° CA BTDC (i.e., Crank Angle Before Top Dead Center).

The above diesel fuel combustion system is particularly favorably employable in EGR system (i.e., exhaust gas recirculation system).

Accordingly, the present invention further provides a diesel fuel combustion system which comprises burning a diesel fuel composition comprising a major portion of diesel fuel and 0.1 to 40 vol. % of a carbonic acid diester of the formula:

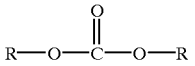

in which R represents a lower hydrocarbon group having 1 to 6 carbon atoms in a diesel engine by injecting the diesel fuel composition into its combustion room at an injection timing of 17 to 2° CA BTDC; and returning a portion of its exhaust gas produced by the above burning into the combustion room to burn the returned exhaust gas together with a freshly injected diesel fuel composition.

DETAILED DESCRIPTION OF THE INVENTION

Figure 1A:
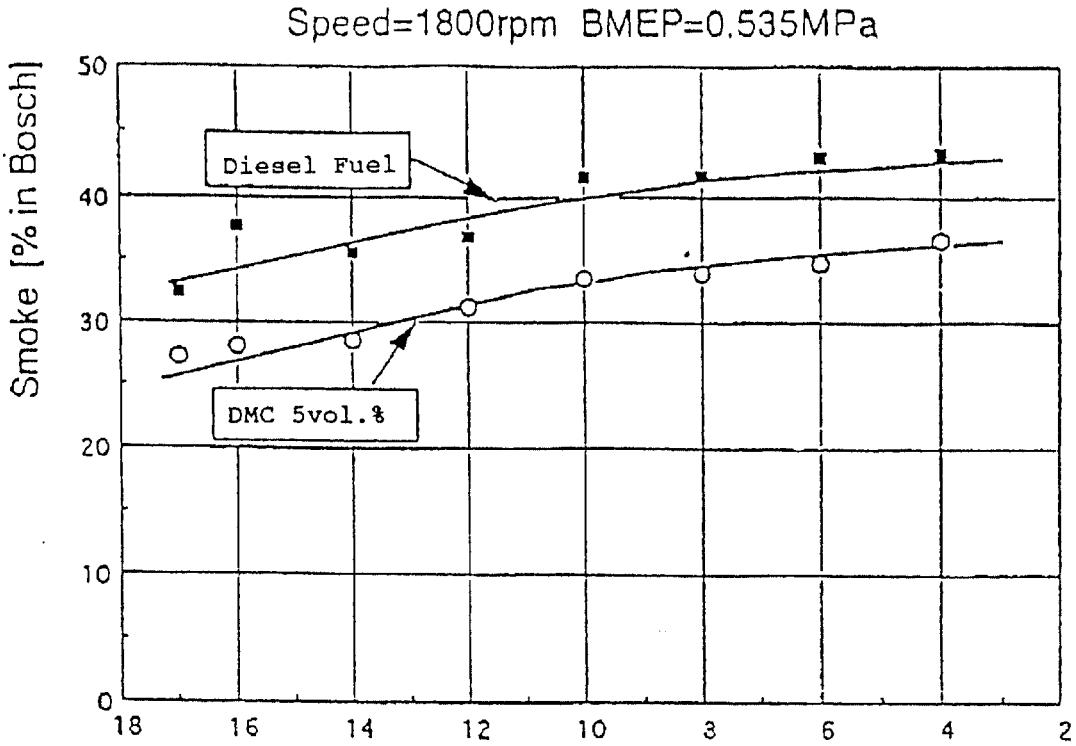
FIGS. 1(*a*) and 1(*b*) is a set of graphs in which the upper graph illustrates a relationship between the fuel injection timing and the amount of smoke contained in the exhaust gas, and the lower graph illustrates a relationship between the fuel injection timing and the amount of nitrogen oxide contained in the exhaust gas.

The improved diesel fuel combustion system of the present invention is characterized by employing the combination of a diesel fuel composition containing a carbonic acid diester and the specifically selected diesel engine operating condition which is defined by the crank angle before top dead center, i.e., CA BTDC. The direction injection system is preferably employed.

The following describes CA BTDC in more detail.

The crank is attached to a revolving shaft at one end and to a reciprocating piston within an internal engine. When CA BTDC is 0°, the combustion room of the internal engine has the minimum volume. When CA BTDC is 180°, the combustion room has the maximum volume. For instance, 10° CA BTDC means the condition that a diesel fuel composition is injected into the combustion room before the combustion room has the minimum volume at a crank angle of 10°. In other words, the 10° CA BTDC means -10° CA ATDC (Crank Angle After Top Dead Center). Generally, burning (quick burning, or explosion) of the injected diesel fuel takes place between 0° and 5° CA ATDC.

Any of generally employable diesel fuels can be used for the preparation of the diesel fuel composition of the invention. The diesel fuel is a mixture of a variety of hydrocarbon compounds such as paraffins (i.e., aliphatic hydrocarbons), cycloparaffins, and aromatic hydrocarbons. For instance, the preferably employable diesel fuel has a boiling point of approx. 160 to 400° C., particularly 180 to 380° C. and a cetane number of 40 to 100, particularly 45 to 95. Heavy oils type A, type B and type C having cetane numbers of 30 to 100 are also employable.

The diesel fuel may contain appropriate additives such as nitrite esters and nitrate esters) in a small amount such as less than 10 vol. %.

The carbonic acid diester employed in the invention has the formula:

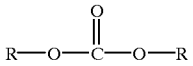

in which R represents a lower hydrocarbon group having 1 to 6 carbon atoms.

Examples of the lower hydrocarbon groups include lower alkyl groups (i.e., aliphatic hydrocarbon group) having 1 to 6 carbon atoms such as methyl, ethyl, n-propyl, isopropyl, n-butyl, isobutyl, tert-butyl, n-pentyl, isopentyl, n-hexyl and isohexyl); alicyclic hydrocarbon groups having 3 to 6 carbon atoms such as cyclopropyl, cyclopentyl, cyclohexyl; unsaturated hydrocarbon groups having 2 to 6 carbon atoms such as propenyl; and aromatic hydrocarbon groups such as phenyl. Preferred are lower alkyl groups having 1 to 4 carbon atoms such as methyl, ethyl, propyl and butyl. The carbonic acid diester preferably is dimethyl carbonate.

The carbonic acid diester of the invention preferably contains no carbonic acid esters of other types such as condensation product of carbonic acid diesters, carbonic acid diesters having alkyl groups of 7 or more carbon atoms, and carbonic acid monoester. These unfavorable carbonic acid esters can be incorporated into the carbonic acid diester of the invention as by-products. In that case, the by-products should be less than 2 wt.%, particularly less than 1 wt. %, more particularly less than 0.5 wt. %.

The condensation product of carbonic acid diester can be represented by the following formula:

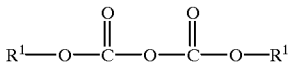

in which $R^1$ is a hydrocarbon group.

The carbonic acid diester of other types may have the formula:

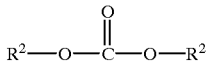

in which R represents a lower hydrocarbon group having 7 or more carbon atoms.

The carbonic acid monoester can be represented by the following formula:

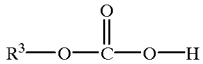

in which $R^3$ represents a hydrocarbon group.

The carbonic acid diester of the invention is incorporated into the diesel fuel in an amount of 0.1 to 40 vol. %, preferably 0.2 to 20 vol. %, more preferably 0.3 to 15 vol. %, per the total volume of the diesel fuel composition. Particularly preferred is incorporation of 0.5 to 12 vol. % of the pure carbonic acid diester.

The carbonic acid diester of too small amount incorporated to the diesel fuel is not effective to reduce the amounts of smoke and nitrogen oxide in the exhaust gas. The carbonic acid diester of excessive amount may cause decrease of power of the diesel engine.

There are no specific limitations with respect to the diesel engines to be used in the invention. For instance, small-sized or middle-sized high speed engines for automobiles, railroads, and agricultural machines can be employed. Also employed are middle-sized middle speed engines and large-sized low speed engines for marine vehicles and electric power generation systems. Nevertheless, the new diesel fuel combustion system of the present invention is preferably utilized for automobiles and agricultural vehicles and machines which use engines giving the maximum rotation speed of 1,200 r.p.m. or more and an engine swept volume of 10 to 100,000 cc (preferably 40 to 80,000 cc).

The diesel fuel combustion system of the invention is particularly favorably employable in diesel engines utilizing EGR system (exhaust gas recirculation system). It is well known that increase of the recirculation ratio of the EGR system results in decrease of the amount of nitrogen oxide but gives increase of the amount of smoke. Accordingly, the recirculation ratio in the EGR system cannot be increased to exceed a certain limit. However, if the diesel combustion system of the invention is utilized, the recirculation ratio can be sufficiently increased because the diesel combustion system of the invention can significantly decrease the amounts of smoke and nitrogen oxide simultaneously. The diesel combustion system of the invention can be utilized in any of known exhaust gas recirculation systems.

According to the diesel fuel combustion system of the invention, the diesel fuel composition containing the carbonic acid diester is injected at an injection timing in the range of 17 to 2° CA BTDC and under condition enabling reduction of amounts of smoke and nitrogen oxide in its exhaust gas. The smoke is particularly significantly reduced when the injection timing is adjusted in the range of 17 to 60° CA BTDC (particularly 17 to 8° CA BTDC). The nitrogen oxide is particularly significantly reduced when the injection timing is adjusted in the range of 14 to 2° CA BTDC. Accordingly, the injection timing is preferably adjusted in the range of 14 to 6° CA BTDC, more preferably 14 to 80 CA BTDC when it is intended to particularly reduce the amounts of smoke and nitrogen oxides in the exhaust gas.

If the injection timing of the diesel fuel composition is adjusted in the range of 14 to 2° CA BTDC, particularly 8 to 2° CA BTDC, an amount of hydrocarbon in its exhaust gas is significantly reduced in addition to the reduction of the amounts of smoke and nitrogen oxide.

If the injection timing of the diesel fuel composition is adjusted in the range of 16 to 80 CA BTDC, an amount of carbon monoxide in its exhaust gas is significantly reduced in addition to the reduction of the amounts of smoke and nitrogen oxide.

If the injection timing of the diesel fuel composition is adjusted in the range of 14 to 80 CA BTDC, an amounts of and hydrocarbon and carbon monoxide in its exhaust gas is significantly reduced in addition to the reduction of the amounts of smoke and nitrogen oxide.

There are no specific limitations with respect the load of the diesel engines to be used in the diesel fuel combustion system of the invention. In loads at any level, the diesel fuel combustion system of the invention can decrease the amounts of the unfavorable products in the exhaust gas. However, it has been noted that the reduction of the amount of smoke is more significantly observed at levels of greater load. Accordingly, the load is preferably adjusted to 0.1 MPa in terms of BMEP (i.e., Brake Mean Effective Pressure) or more, particularly 0.3 MPa or more.

The following examples illustrate the present invention in more detail.

Engine Test Conditions and Measurements (1) Engine

Diesel Engine Type DV-9 produced by Mitsubishi Motor Industry Co., Ltd, having the following specifications.

| | |
|---|---|
| Engine System | |
| Bore × Stroke | 100 mm × 105 mm |
| Engine Swept Volume | 825 $cm^3$ |
| Swirl Ratio | 3.2 |
| Compression Ratio | 18.5 (standard head)<br>16.6 (TIC head) |
| Type of Combustion Room | toroidal |
| Size (Length × width × height) | 620 mm × 700 mm × 800 mm |
| Injection System | |
| Pump Plunger Size | 9.5 mm |

-continued

| | |
|---|---|
| Lift size | 9.0 mm |
| Injection Timing | Variable |
| Nozzle Diameter | 0.28 mm |
| Number | 5 |
| Valve Pressure | 220 MPa |

(2) Measurement of Smoke

The concentration of smoke was measured by means of Bosch Smoke Meter (produced by Xexel). The exhaust gas was collected at 300 mm in the downstream side from the position on which the flange for attachment of the exhaust gas pipe was arranged. The collected exhaust gas was passed through a filter paper, and the strength of light reflected on the filter paper was measured in a photoelectric detector (produced by Xexel). The measurement was repeated three times and their average value was adopted.

(3) Measurements of Products other than Smoke

The measurements were performed by means of an automobile exhaust gas analyzer (MEXA-8120, trade name, produced by Horiba Seisakusho Co., Ltd.). The exhaust gas was collected directly from the tail pipe, not using a dilution tunnel. In the analyzer, the gas components were measured according to the following methods:

Carbon monoxide: Non-diffusion Infra red method (NDIR method)

Hydrocarbon: Hydrogen flame ionized detection method (FID method)

Nitrogen oxide: Chemical luminescence detection method (CLD method)

In the above measurements, the exhaust gas was collected at 300 mm in the downstream side from the position on which the flange for attachment of the exhaust gas pipe was arranged. The collected exhaust gas was passed through the first filter to be sent to the second filter in the exhaust gas analyzer through a heated stainless pipe of approx. 10 m long. In advance of the measurement, a gas containing a known amount of the product to be analyzed was measured for calibration.

EXAMPLE 1

A diesel fuel composition containing 5 vol. % of dimethyl carbonate (DMC) was burned in the diesel engine under the conditions of 1,800 r.p.m. of a rotation rate, 0.535 MPa of BMEP, and a fuel injection timing varying in the range of 17 to 40° CA BTDC.

Figure 1B:
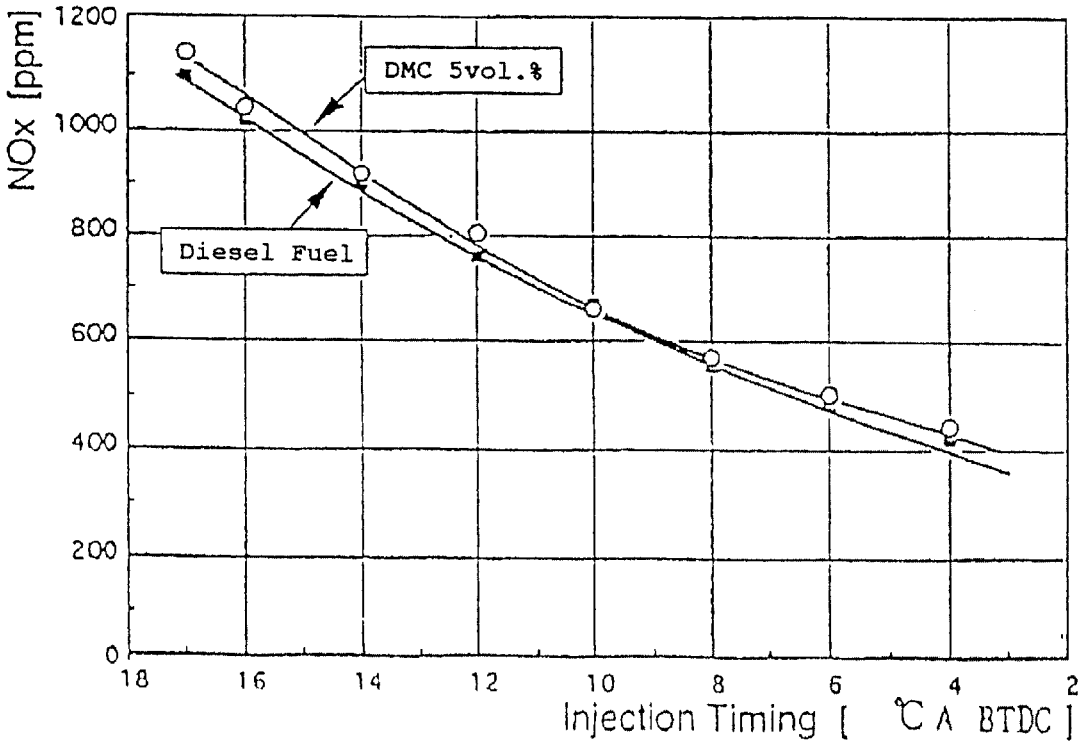
Figure 2:
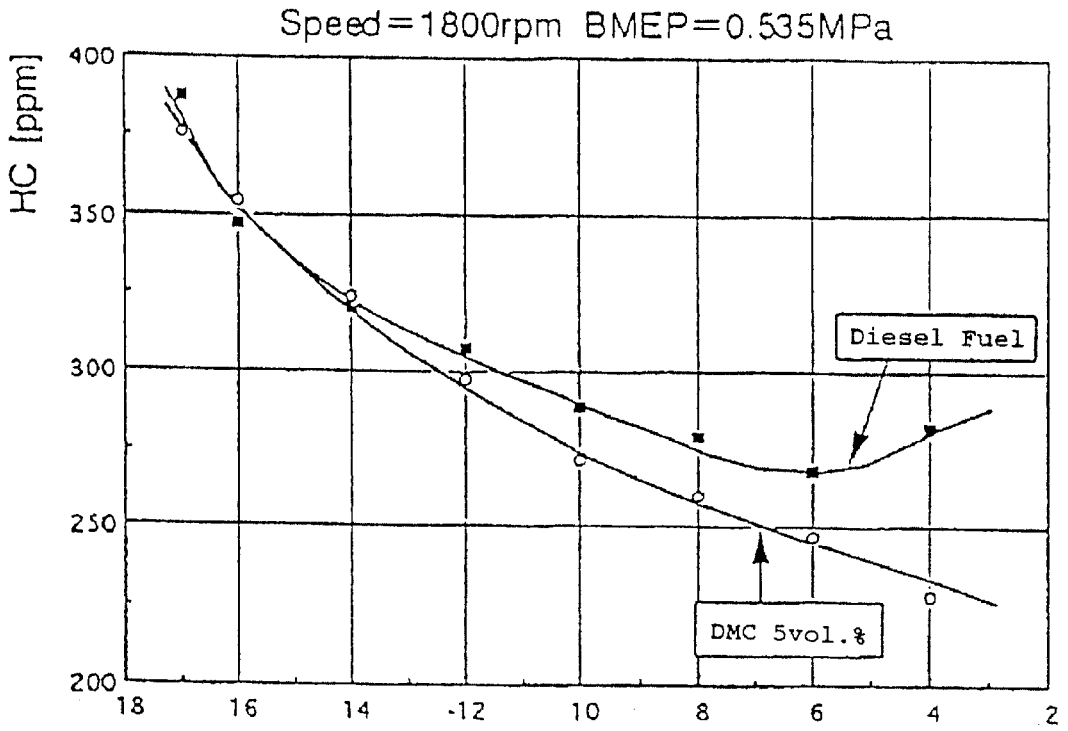
FIGS. 2(*a*) and 2(*b*) is a set of graphs in which the upper graph illustrates a relationship between the fuel injection timing and the amount of hydrocarbon contained in the exhaust gas, and the lower graph illustrates a relationship between the fuel injection timing and the amount of carbon monoxide oxide contained in the exhaust gas.
Figure 2B:
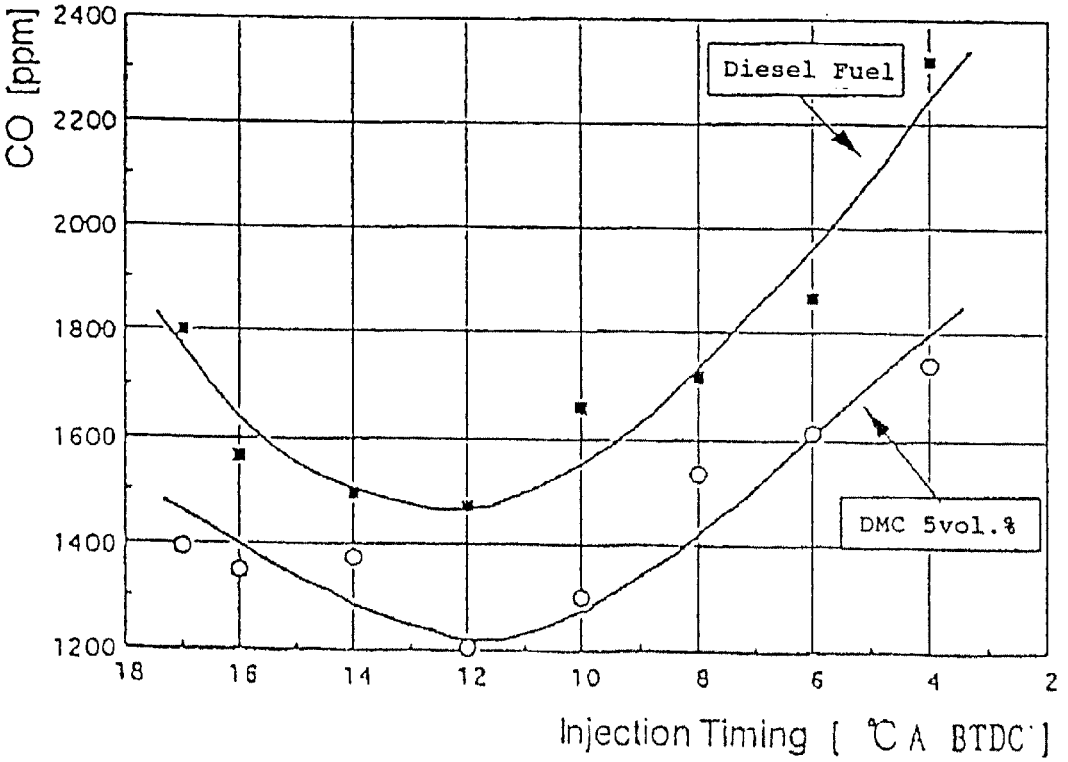

The measured values for smoke, nitrogen oxide, hydrocarbon, and carbon monoxide are graphically illustrated in FIGS. 1 to 2.

COMPARISON EXAMPLE 1

The diesel fuel per se containing no dimethyl carbonate was burned in the diesel engine under the same conditions as those of Example 1.

The measured values for smoke, nitrogen oxide, hydrocarbon, and carbon monoxide are graphically illustrated in FIGS. 1 to 2.

EXAMPLE 2

Each of diesel fuel compositions containing different amounts of dimethyl carbonate, namely, 5 vol. %, 6.5 vol. %, 8 vol. %, 10 vol. % and 12 vol. % was burned in the diesel engine under the conditions of 1,800 r.p.m. of a rotation rate, 0.535 MPa of PMEP, and 10° CA BTDC of the fuel injection timing.

Figure 3:
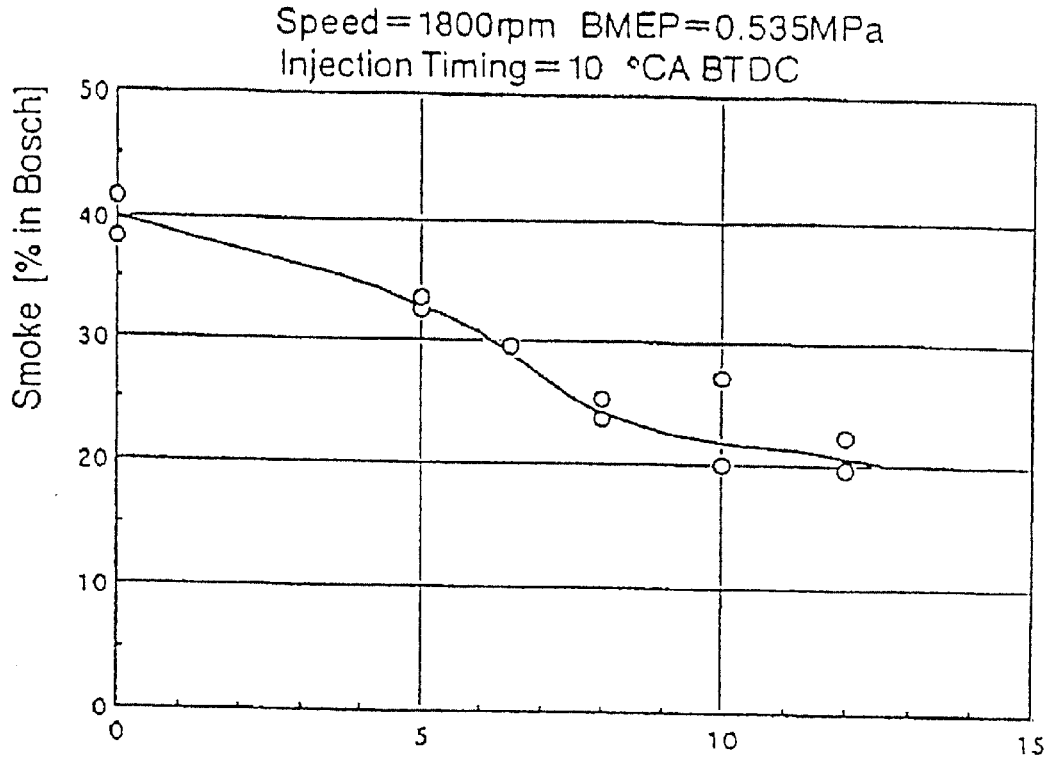
FIGS. 3(*a*) and 3(*b*) is a set of graphs in which the upper graph illustrates a relationship between the amount of dimethyl carbonate incorporated into the fuel and the amount of smoke contained in the exhaust gas, and the lower graph illustrates a relationship between the amount of dimethyl carbonate and the amount of nitrogen oxide contained in the exhaust gas.
Figure 3B:
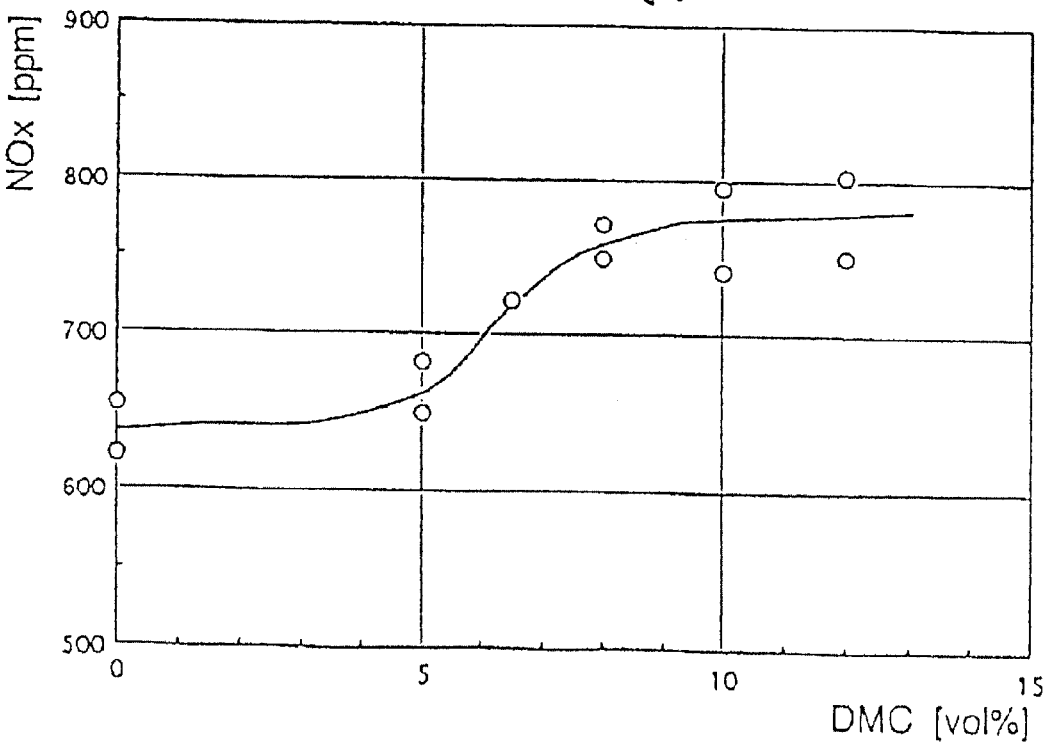
Figure 4:
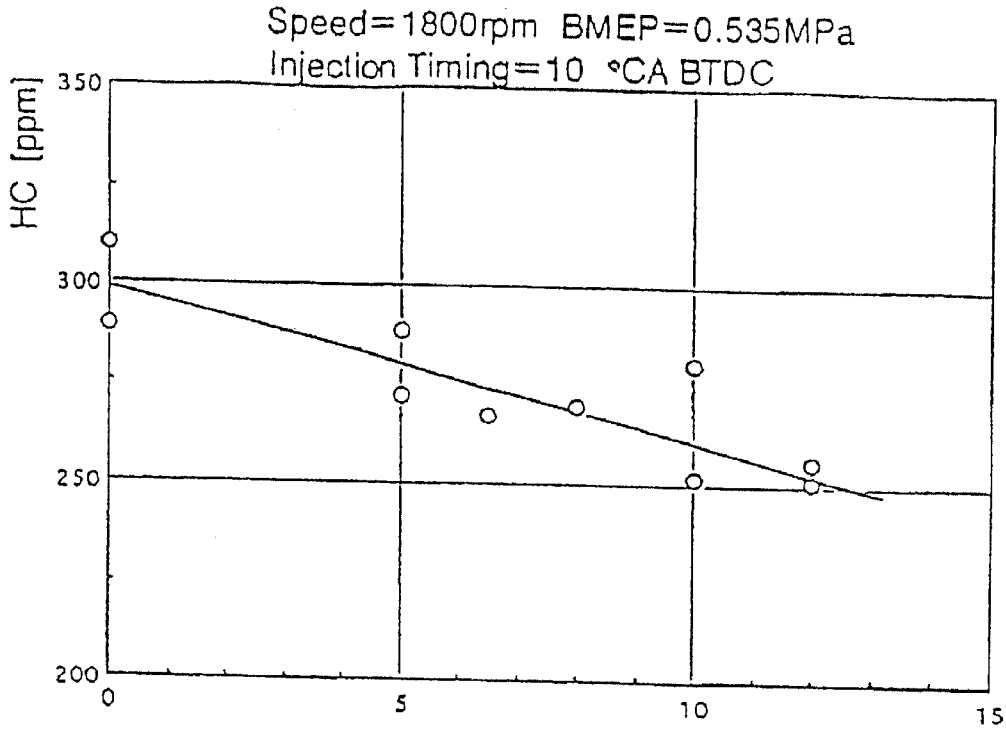
FIGS. 4(*a*) and 4(*b*) is a set of graphs in which the upper graph illustrates a relationship between the amount of dimethyl carbonate incorporated into the fuel and the amount of hydrocarbon contained in the exhaust gas, and the lower graph illustrates a relationship between the amount of dimethyl carbonate and the amount of carbon monoxide contained in the exhaust gas.
Figure 4:
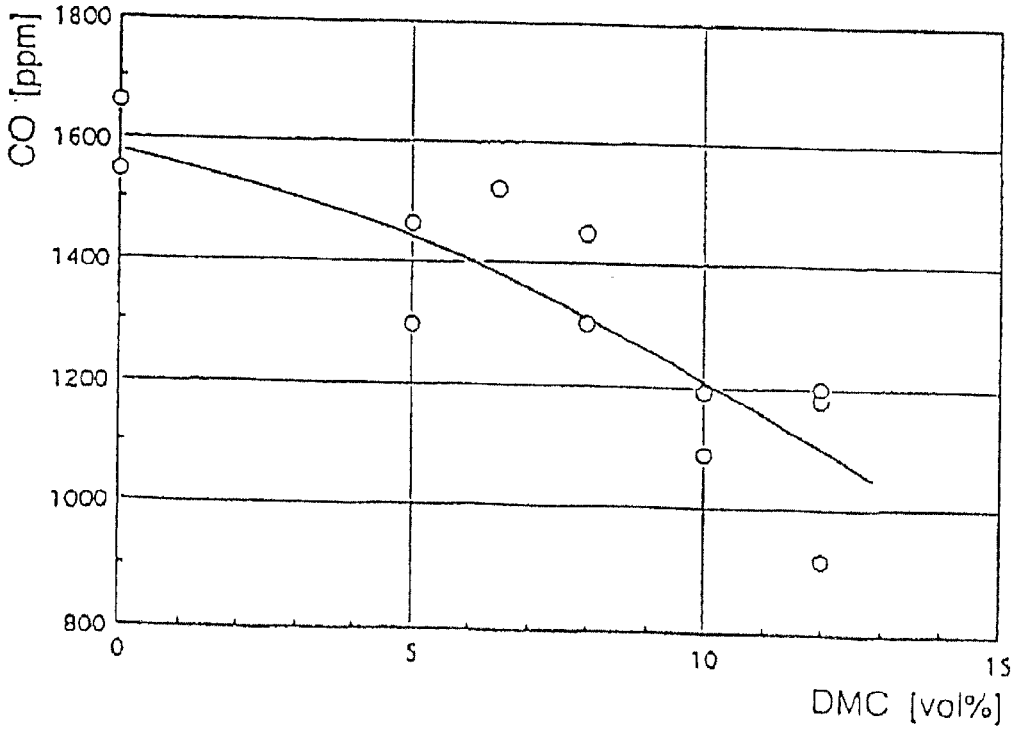

The measured values for smoke, nitrogen oxide, hydrocarbon, and carbon monoxide are graphically illustrated in FIGS. 3 to 4.

COMPARISON EXAMPLE 2

The diesel fuel per se containing no dimethyl carbonate was burned in the diesel engine under the same conditions as those of Example 2.

The measured values for smoke, nitrogen oxide, hydrocarbon, and carbon monoxide are graphically illustrated in FIGS. 3 to 4.

EXAMPLE 3

Each of diesel fuel compositions containing 5 vol. % and 10 vol. % of dimethyl carbonate was burned in the diesel engine under the conditions of 1,800 r.p.m. of a rotation rate, 100° CA BTDC of the fuel injection timing, and BMEP varying within 0.1 to 0.6 MPa.

Figure 5:
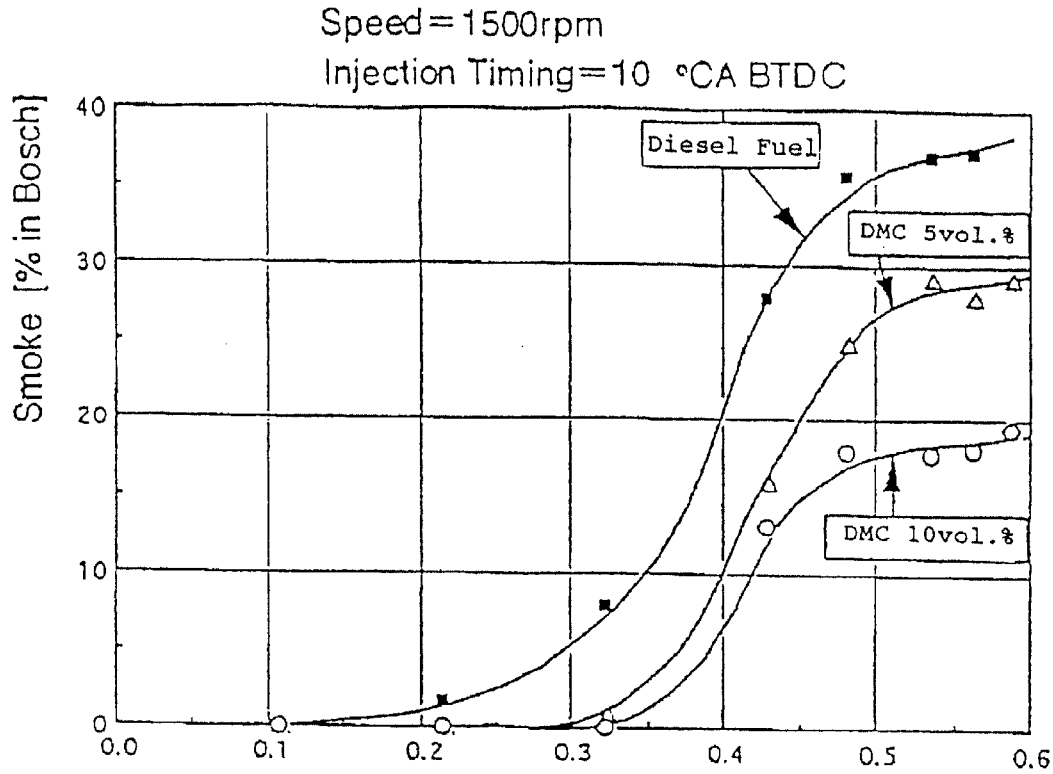
FIGS. 5(*a*) and 5(*b*) is a set of graphs in which the upper graph illustrates a relationship between the load of diesel engine employed and the amount of smoke contained in the exhaust gas, and the lower graph illustrates a relationship between the load of diesel engine and the amount of nitrogen oxide contained in the exhaust gas.
Figure 5B:
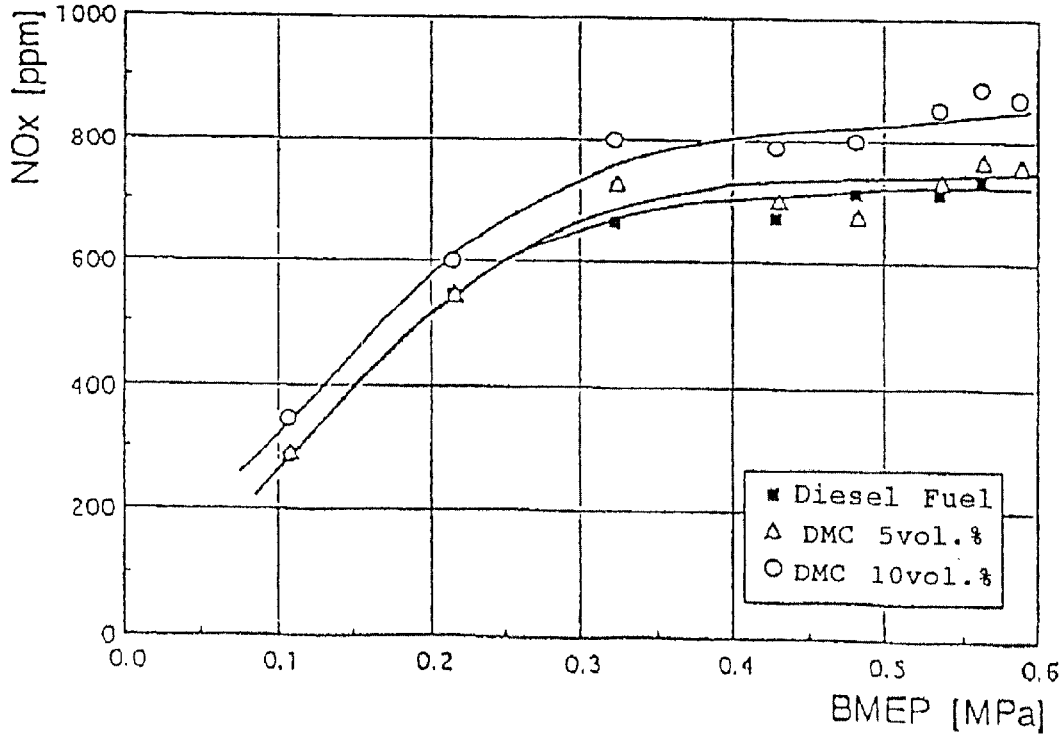
Figure 6:
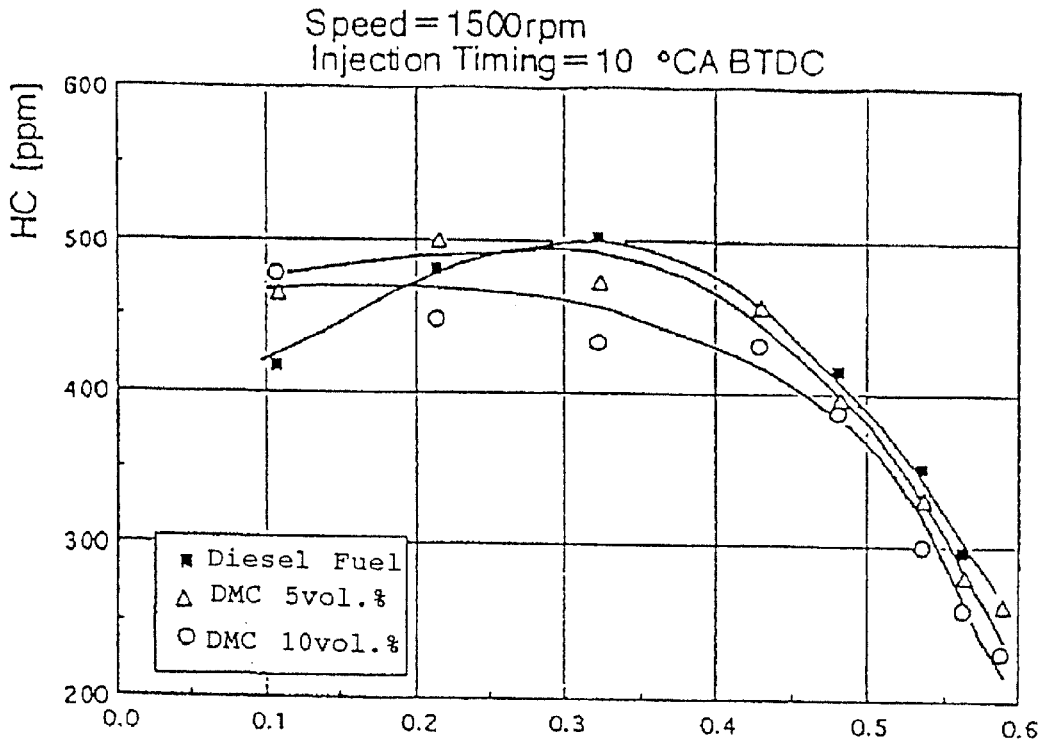
FIGS. 6(*a*) and 6(*b*) is a set of graphs in which the upper graph illustrates a relationship between the load of diesel engine employed and the amount of hydrocarbon contained in the exhaust gas, and the lower graph illustrates a relationship between the load of diesel engine and the amount of carbon monoxide contained in the exhaust gas.
Figure 6:
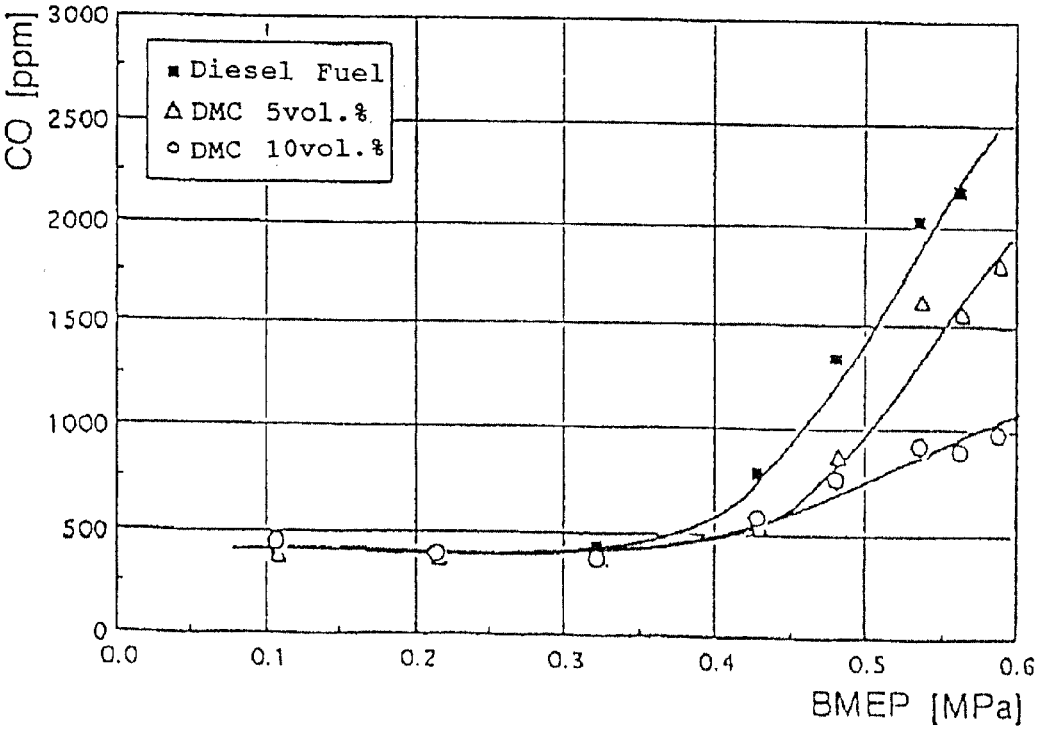

The measured values for smoke, nitrogen oxide, hydrocarbon, and carbon monoxide are graphically illustrated in FIGS. 5 to 6.

COMPARISON EXAMPLE 3

The diesel fuel per se containing no dimethyl carbonate was burned in the diesel engine under the same conditions as those of Example 3.

The measured values for smoke, nitrogen oxide, hydrocarbon, and carbon monoxide are graphically illustrated in FIGS. 5 to 6.

EXAMPLE 4

The diesel fuel composition containing 10 vol. % of dimethyl carbonate was burned in the diesel engine equipped with an EGR system under the conditions of 1,800 r.p.m. of a rotation rate, 0.535 MPa of BMEP, and 12° CA BTDC of the fuel injection timing. The EGR system is simulated using a mixture of the diesel fuel composition and carbon dioxide in place of performing actual recirculation of the exhaust gas. The recirculation ratio (EGR ratio) was calculated according to the following formula:

$$\text{EGR ratio}=[CO_2]_{in}/\{[CO_2]_{in}+[CO_2]_{EGR=0}\}$$

in which $[CO_2]_{in}$ means the $C)_2$ concentration in the introduced gas, and $[CO_2]_{EGR=0}$ means the $CO_2$ concentration obtained in the case of using no EGR system.

Figure 7:
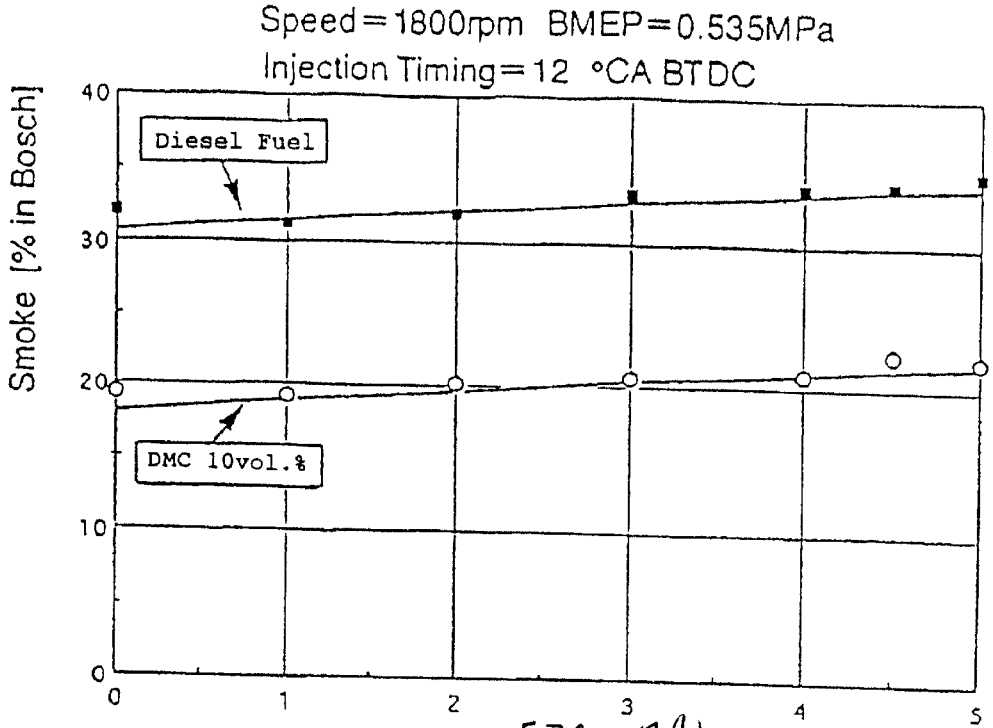
FIGS. 7(*a*) and 7(*b*) is a set of graphs in which the upper graph illustrates a relationship between the recirculation ratio of exhaust gas in a simulated EGR system and the amount of smoke contained in the exhaust gas, and the lower graph illustrates a relationship between the recirculation ratio and the amount of nitrogen oxide contained in the exhaust gas.
Figure 7:
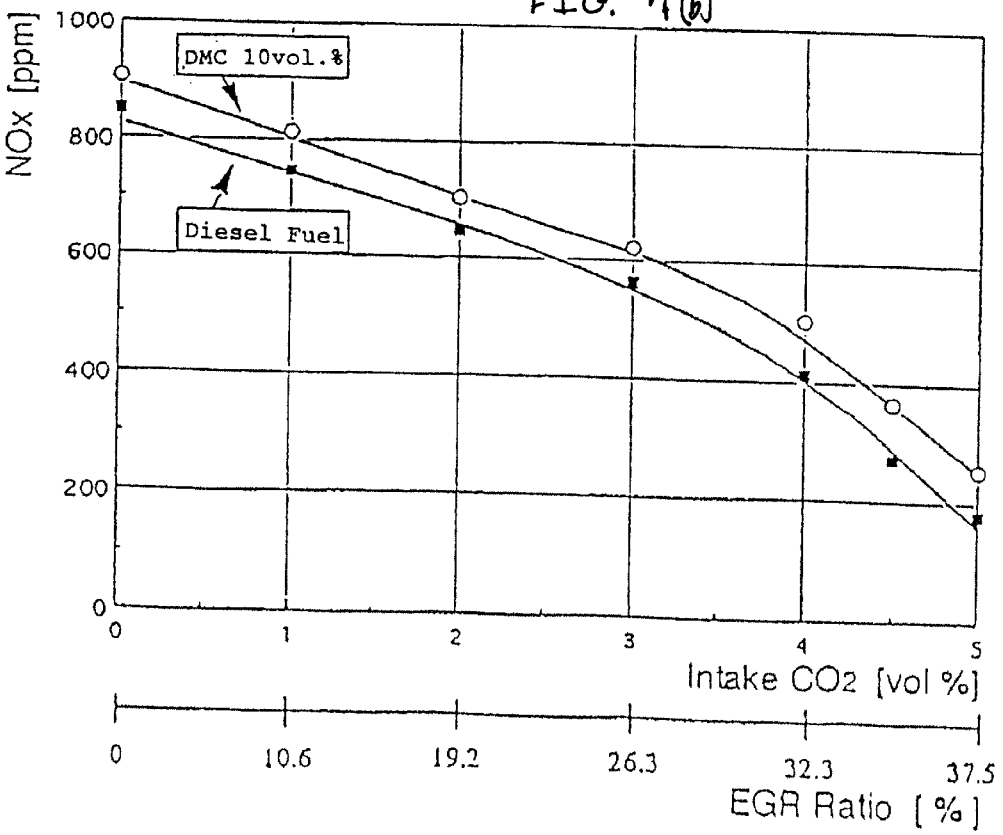
Figure 8:
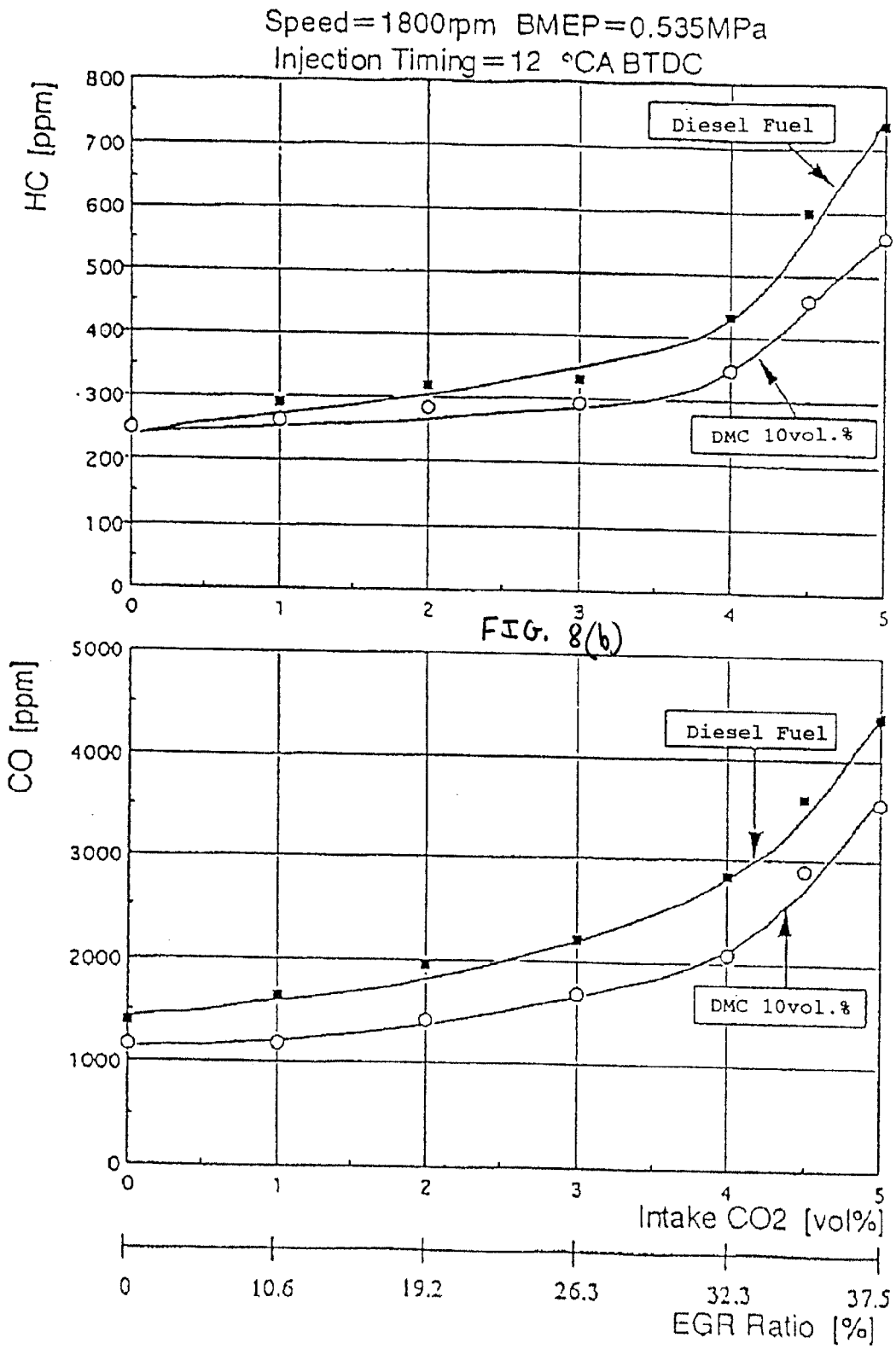
FIGS. 8(*a*) and 8(*b*) is a set of graphs in which the upper graph illustrates a relationship between the recirculation ratio of exhaust gas in a simulated EGR system and the amount of hydrocarbon contained in the exhaust gas, and the lower graph illustrates a relationship between the recirculation ratio and the amount of carbon monoxide contained in the exhaust gas.

The measured values for smoke, nitrogen oxide, hydrocarbon, and carbon monoxide are graphically illustrated in FIGS. 7 to 8.

COMPARISON EXAMPLE 4

The diesel fuel per se containing no dimethyl carbonate was burned in the diesel engine under the same conditions as those of Example 4.

The measured values for smoke, nitrogen oxide, hydrocarbon, and carbon monoxide are graphically illustrated in FIGS. 7 to 8.

EXAMPLE 5

The diesel fuel composition containing 10 vol. % of dimethyl carbonate was burned in the diesel engine equipped with a real EGR system under the conditions of 1,800 r.p.m. of a rotation rate, 0.535 MPa of BMEP, and 12° CA BTDC of the fuel injection timing. The EGR system was operated by circulating the exhaust gas once cooled to room temperature into the intake pipe.

Figure 9:
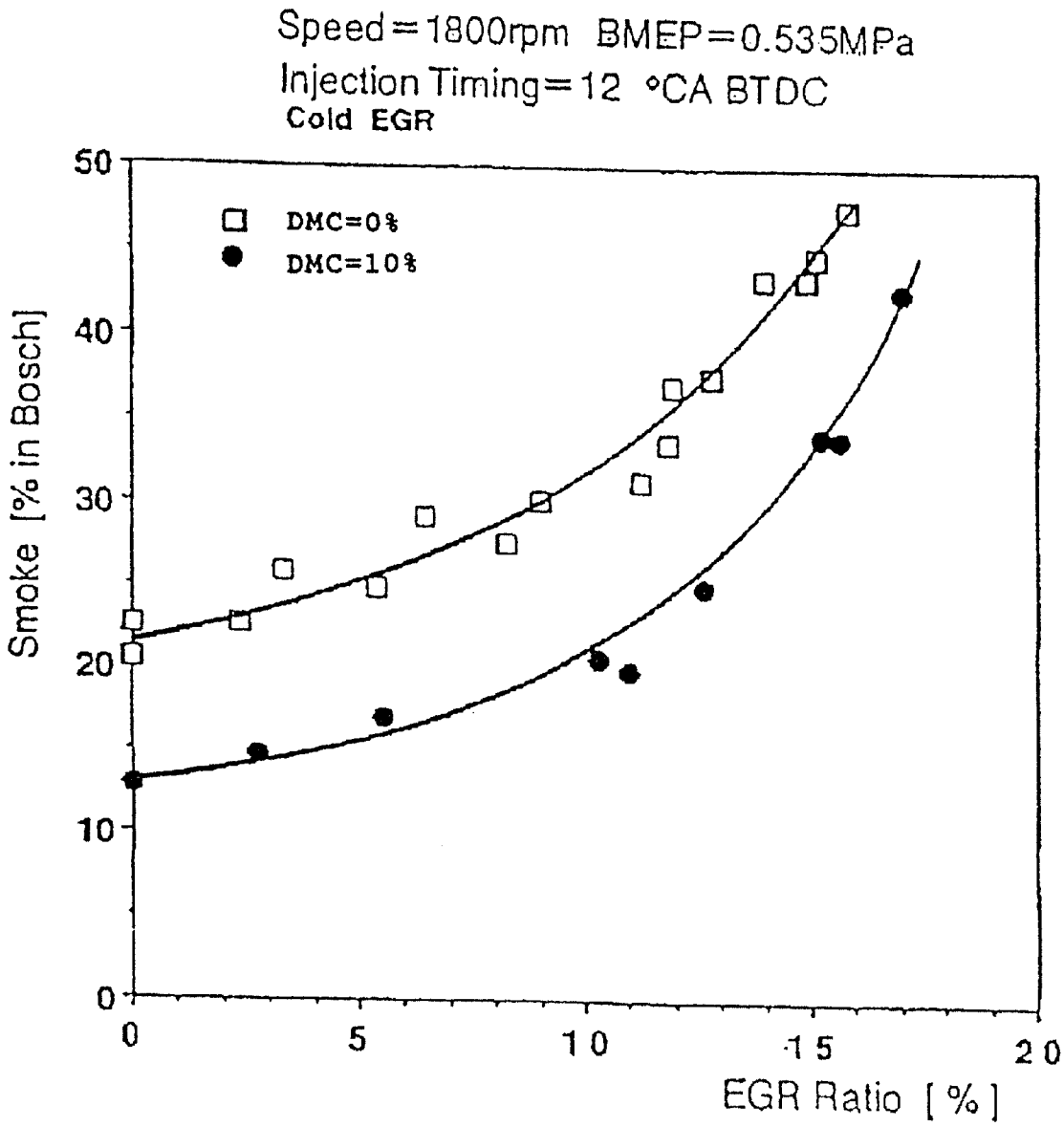
FIG. 9 is a graph showing a relationship between the recirculation ratio of exhaust gas in an actually operated EGR system and the amount of smoke contained in the resulting exhaust gas.
Figure 10:
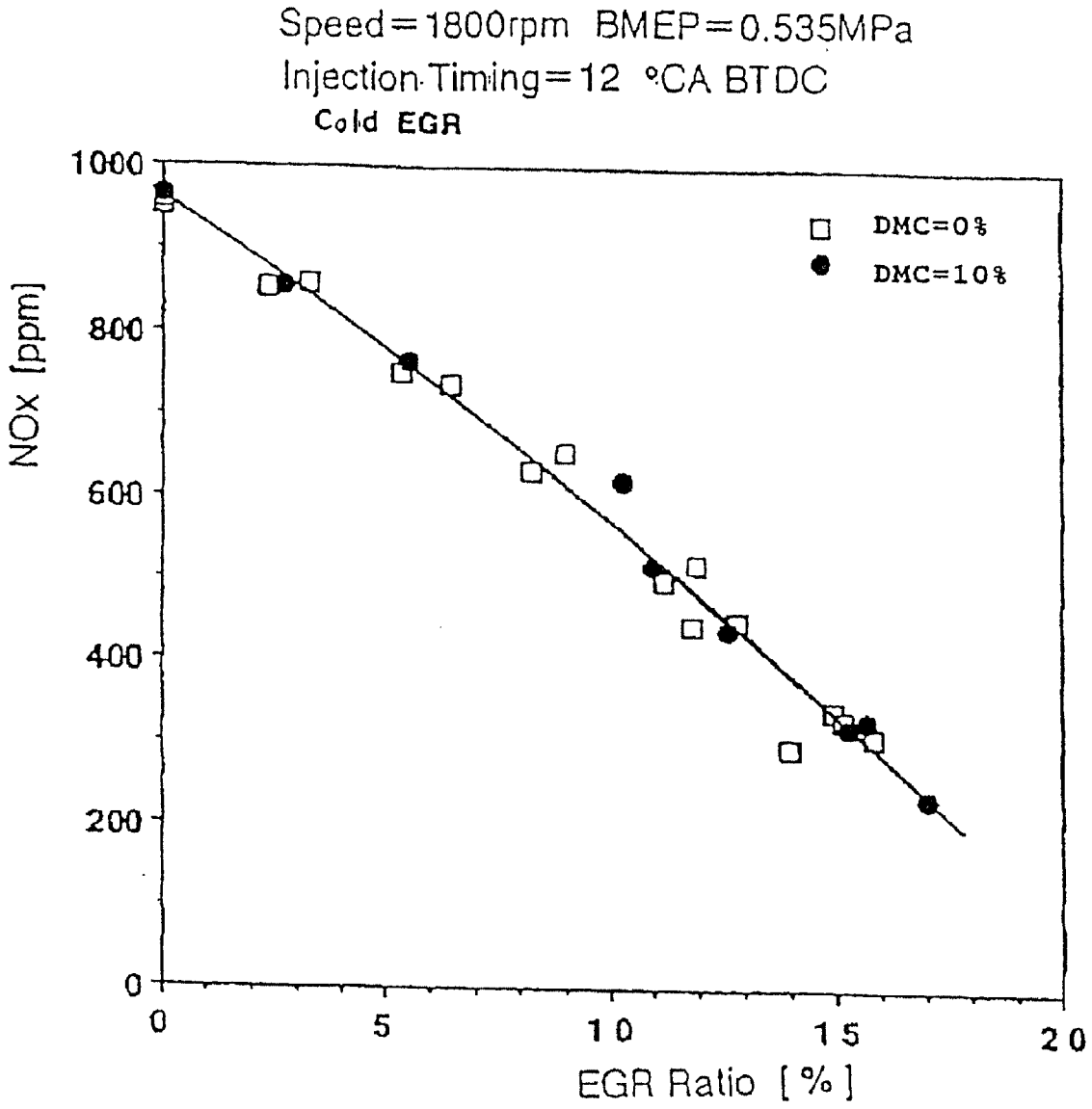
FIG. 10 is a graph showing a relationship between the recirculation ratio of exhaust gas in an actually operated EGR system and the amount of nitrogen oxide contained in the resulting exhaust gas.

The measured values for smoke and nitrogen oxide are graphically illustrated in FIGS. 9 to 10.

COMPARISON EXAMPLE 5

The diesel fuel per se containing no dimethyl carbonate was burned in the diesel engine under the same conditions as those of Example 5.

The measured values for smoke and nitrogen oxide are graphically illustrated in FIGS. 9 to 10.

From the comparison between the results of Example 5 and Comparison Example 5, it is clear that the incorporation of the carbonic acid diester into a diesel fuel and the employment of the specific fuel injection timing are effective to reduce the amounts of smoke and nitrogen oxide in the exhaust gas when the circulation ratio is increased.

What is claimed is:

1. A process for burning a diesel fuel composition which comprises burning a diesel fuel composition a major portion of diesel fuel and 0.1 to 40 vol. % of dimethyl carbonate in a diesel engine by injecting the diesel fuel composition into its combustion room at an injection timing of 14 to 2° crank angle before top dead center CA BTDC.

2. The process of claim 1, wherein the diesel fuel composition is injected at an injection timing in the range of 14 to 80° CA BTDC.

3. The process of claim 1, wherein the dimethyl carbonate is contained in an amount of 0.5 to 12 vol. % in the diesel fuel.

4. A process for burning a diesel fuel composition which comprises burning a diesel fuel composition a major portion of diesel fuel and 0.1 to 40 vol. % of dimethyl carbonate.

in a diesel engine by injecting the diesel fuel composition into its combustion room at an injection timing of 14 to 2° crank angle before top dead center CA BTDC; and returning a portion of its exhaust gas produced by the above burning into the combustion room to burn the returned exhaust gas together with a freshly injected diesel fuel composition.

5. The process of claim 4, wherein the diesel fuel composition is injected at an injection timing in the range of 14 to 8° CA BTDC.

6. The process of claim 4, wherein the dimethyl carbonate is contained in an amount of 0.5 to 12 vol. % in the diesel fuel.

* * * * *